US007938282B1

(12) United States Patent
Hawry et al.

(10) Patent No.: US 7,938,282 B1
(45) Date of Patent: May 10, 2011

(54) CLOSURE FOR A CONTAINER

(75) Inventors: Liam Hawry, Chicago, IL (US); Scott Jost, Naperville, IL (US); Ralph Guy Considine, Libertyville, IL (US)

(73) Assignee: Berlin Packaging, LLC, Chicago, IL (US)

( * ) Notice: Subject to any disclaimer, the term of this patent is extended or adjusted under 35 U.S.C. 154(b) by 641 days.

(21) Appl. No.: 12/016,308

(22) Filed: Jan. 18, 2008

(51) Int. Cl.
*B65D 25/28* (2006.01)
*B65D 41/04* (2006.01)

(52) U.S. Cl. ..... 215/305; 220/212.5; 220/288

(58) Field of Classification Search ..... 215/305; 220/212.5, 288
See application file for complete search history.

(56) References Cited

U.S. PATENT DOCUMENTS

| | | | | |
|---|---|---|---|---|
| 3,259,233 | A * | 7/1966 | Beeman | 220/214 |
| 6,216,902 | B1 * | 4/2001 | Hurford | 220/212.5 |
| 6,223,924 | B1 * | 5/2001 | Ek et al. | 220/258.4 |
| 6,364,146 | B1 * | 4/2002 | Beckerer, Jr. | 220/288 |
| 6,783,014 | B2 * | 8/2004 | Luker | 215/334 |
| 7,056,265 | B1 * | 6/2006 | Shea | 482/8 |
| 7,624,889 | B2 * | 12/2009 | Tharp et al. | 220/288 |
| 7,644,734 | B2 * | 1/2010 | Palmer | 138/89 |
| 7,766,182 | B2 * | 8/2010 | Trent et al. | 220/288 |
| 2004/0011759 | A1 * | 1/2004 | Hahn et al. | 215/305 |
| 2008/0156802 | A1 * | 7/2008 | Yauk et al. | 220/253 |
| 2009/0206082 | A1 * | 8/2009 | Vovan | 220/266 |
| 2009/0223959 | A1 * | 9/2009 | Schulz et al. | 220/255 |

* cited by examiner

*Primary Examiner* — Anthony Stashick
*Assistant Examiner* — Niki M Eloshway
(74) *Attorney, Agent, or Firm* — Adam K. Sacharoff; Much Shelist

(57) ABSTRACT

A closure for a container having a top portion having a centered region; and a plurality of slots radially arrayed about the top section, each slot being sized to receive a finger tip of a human hand interspaced about the top portion.

12 Claims, 5 Drawing Sheets

CLOSURE FOR A CONTAINER

FIELD OF THE INVENTION

The present invention relates to closures for a container or more particularly to a closure that facilitates the processes of sealing, opening and securely re-closing a container.

BACKGROUND OF THE INVENTION

Closures for containers are well known. Recently however, more industries are adopting continuous threaded closures. One such industry is the coatings industry. For many years, the coatings industry has employed friction-fit closures. It was typical that such closures had to be pried from their containers and pounded back into place, requiring the user to employ one or more tools. Recently the coatings industry has begun providing or outfitting containers with continuous threaded closures to seal the container and to allow users to open and close the containers without tools. Given the viscous and adhesive nature of coatings in the container however, closure and container threads often become clogged with their container's contents. Once clogged, closure and container threads adhere to one another making the removal of the closure difficult and preventing proper thread engagement during closure re-application. There is therefore a need to minimize the closure threads' exposure to the container contents and to maximize users' grip strength and torque during the removal and re-application of the closure from and to the container.

SUMMARY OF THE INVENTION

In one embodiment of the present invention there is provided a closure for a container. The closure includes a cylindrical skirt depending downwardly from a top portion and a plurality of slots interspaced about the top portion and sized to receive a finger tip of a human hand. Each slot has an opening facing the cylindrical skirt, a back wall radially facing the center of the top portion and the opening and a walled section extending from the back wall around either side of the slot. The shape of each slot may in some embodiments be defined to form a partially elliptical shape.

In another embodiment the top portion may further include a first tapered annular section that extends upwardly and inwardly from the cylindrical skirt and includes a second tapered annular section extending upwardly and inwardly from an intervening edge between the first tapered annular section and the second tapered annular section. The second tapered annular section may further have a secondary edge distal from the intervening edge, the secondary edge positioned to separate the second tapered annular section from a region that slopes upwardly and radially inwardly towards the centered region defined by the top section.

In another embodiment the first tapered annular section is defined to have a higher rise angle then the second tapered annular section.

In yet another embodiment, the closure would further include an upwardly rounded edge on the secondary edge positioned only between two slots, of the plurality of slots.

In another embodiment, each slot, of the plurality of slots, is further defined as including an indent having a surface boundary formed from the secondary edge of the second tapered annular section which forms into a downwardly sloped section. The surface boundary continues from the downwardly sloped section into a bowed section and then merges into an upwardly sloped section. The upwardly sloped section then levels into an extension section moving inwardly towards the centered region. Finally, the extension section forms into a wall section that merges at an edge with the top section.

In one or more of the embodiment, the plurality of slots may be defined as seven slots radially and equally spaced around the top section.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
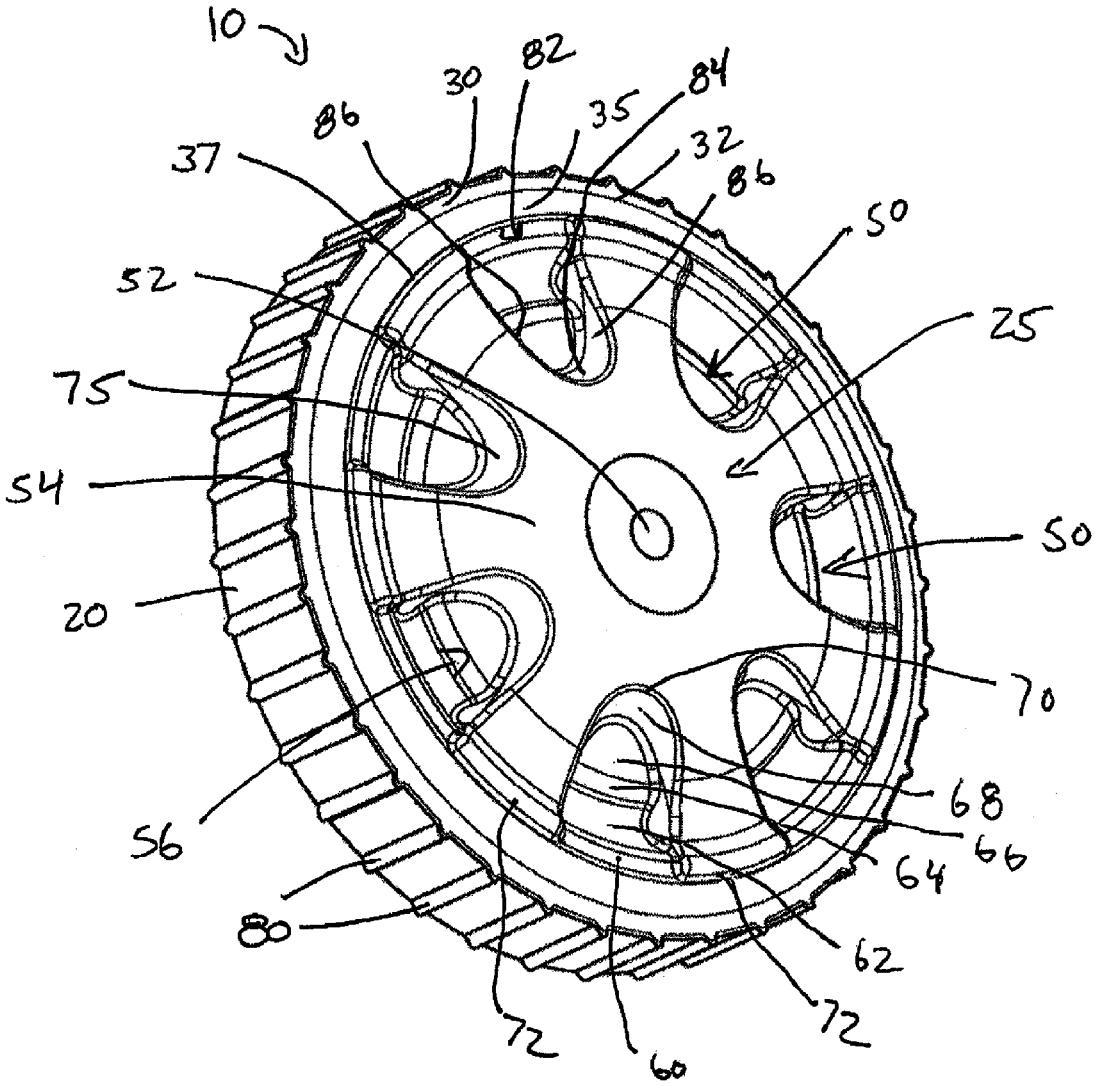
FIG. 1 is a top perspective view of a closure in accordance to an embodiment of the present invention.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Figure 4:
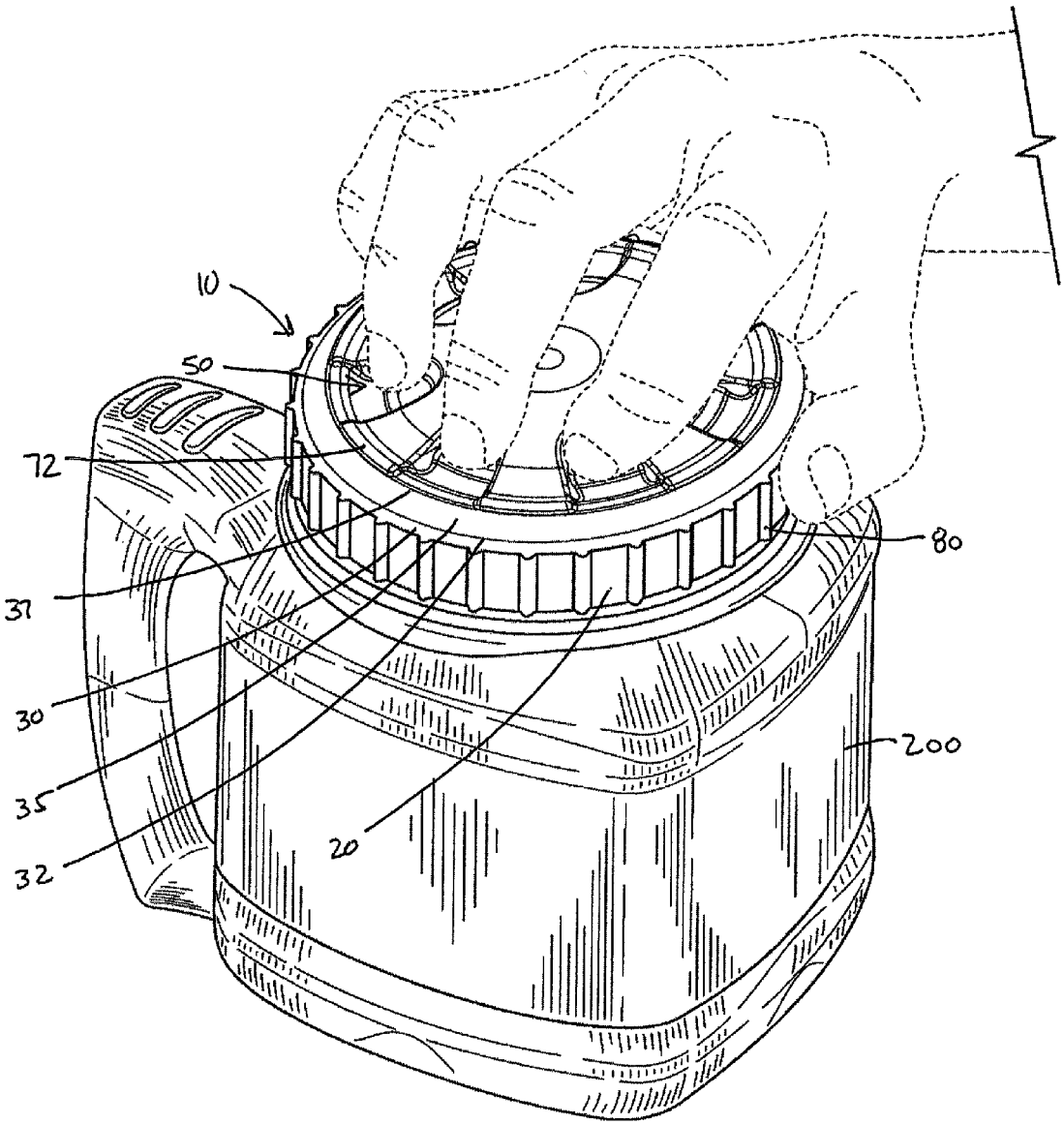
FIG. 4 is a perspective view of the closure in accordance to an embodiment of the present invention shown secured to a container and illustrating a user hand with, its fingers properly placed for removal of the closure from the container.
Figure 5:
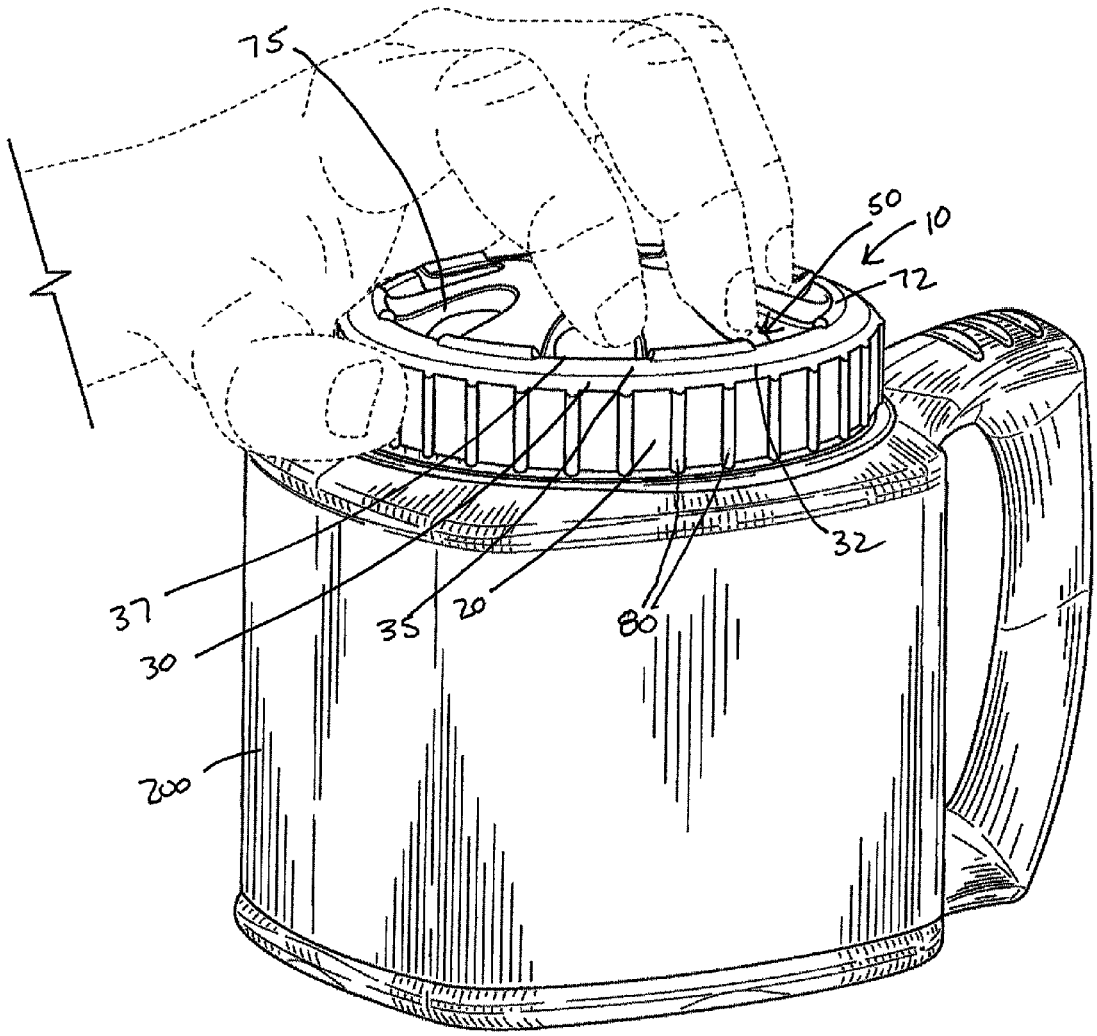
FIG. 5 is another perspective view of FIG. 4

Referring now to FIG. 1, there is shown a closure or cap 10 for use with a container 200, shown in FIGS. 4 and 5. The cap 10 includes a cylindrical skirt 20 depending downwardly from a top portion 25. The internal surface of the cylindrical skirt 20 includes at least one thread 22 used for mating and securing the closure 10 onto corresponding threads defined on the container 200. In addition, the internal surface of the closure 10 may include one or more annular lips 24 extending downwardly and used to mate, seal, or position itself against an opening surface (not shown) in the container 200.

The top portion 25 includes a first tapered annular section 30 that extends upwardly and inwardly from the cylindrical skirt 20 and includes a second tapered annular second 35 extending upwardly and inwardly from the edge 32 of the first tapered annular section 30. In one embodiment, a rise angle defined as the angle from a horizontal plane decreases significantly from the taper from the first to the second tapered annular section. The edge 37 of the second tapered annular section 35 begins to define the remaining section of the top portion 25.

The remaining section of the top portion 25 on the closure includes a plurality of finger slots 50, which as shown in FIGS. 4 and 5 are defined and sized to receive the finger tips of a user's hand. The user placing one or more finger tips in the finger slots 50 and placing the thumb and $5^{th}$ finger on the outside of the cylindrical skirt 20 will maintain a tight grip on the closure 10. This will also help to increase the amount of torque the user is able to apply to the closure 10 thus improving the user's ability to remove the closure 10 especially if the closure 10 becomes slightly stuck to the container.

Figure 2:
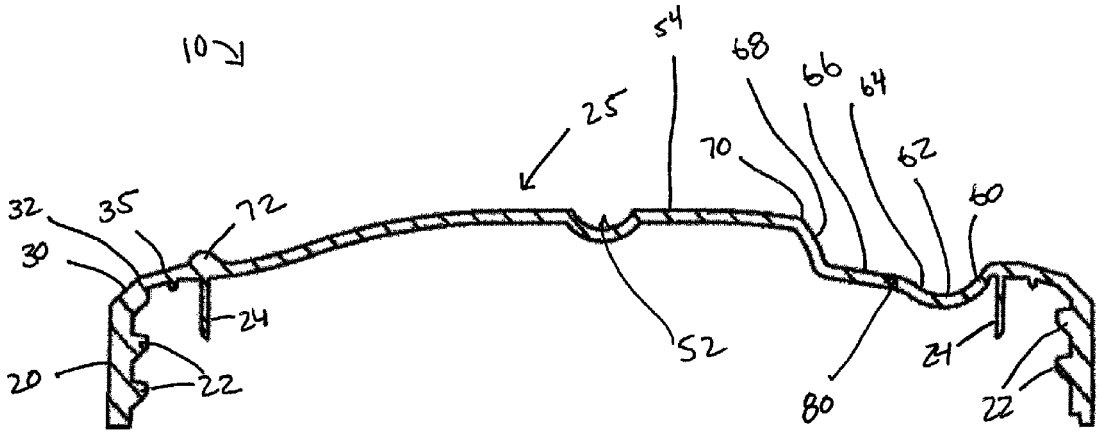
FIG. 2 is a cross sectional view of FIG. 1.
Figure 3:
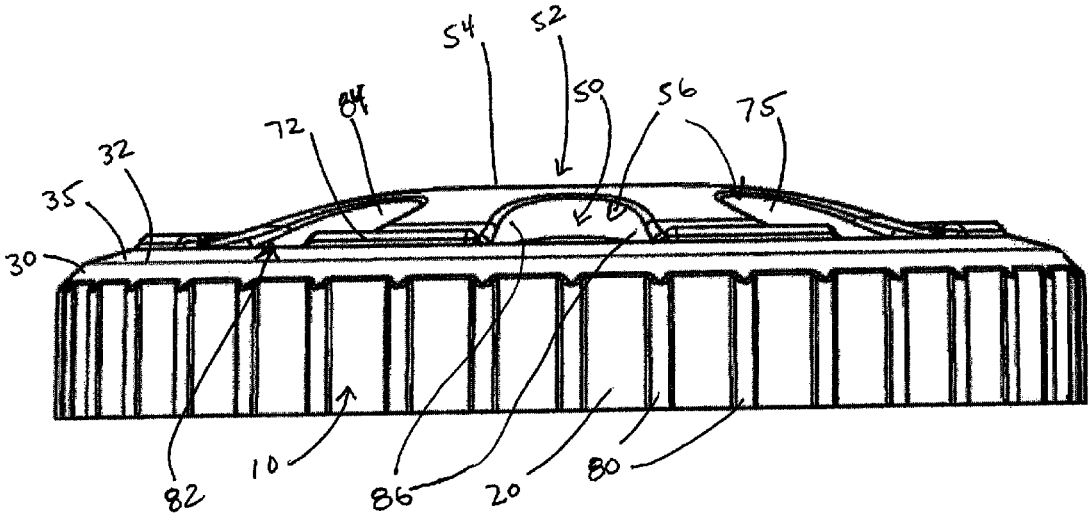
FIG. 3 is a side view of FIG. 1.

Returning to FIGS. 1 through 3, closure 10 includes a centered region 52 and a downwardly and outwardly sloped region 54 extending from the centered region 52 to the edge 37 of the second tapered annular section 35. A plurality of spaced indents 56 in the region 54, extending to the edge 37 of the second tapered annular section 35, begin to define the finger slots 50. The spaced indents 56 start at the edge 37 of the second tapered annular section 35. Each indent 56 has a bottom region 80 defined from an opening 82 of the indent 56 to a back wall 84 of the indent and between the side walls 86 that extend from the back wall to the opening. It being well within the scope of this embodiment to include a back wall 84 that merges into the side walls 86 such as shown and illustrated herein to define a slightly elliptical indent. Other shapes are described below.

The bottom region 80 is further defined as having a first portion 60 slopped downwardly from the edge 37. From the first portion 60, the spaced indents 56, then bow at a second portion 62 and begin to slope upwardly to form a third portion 64. The third portion 64 levels and extends slightly upwardly into a fourth portion 66. The fourth portion 66 extends further inwardly towards the centered region 52 and raises at a fifth portion 68 to define a wall 75. The wall 75 may further extend around the spaced indent to define the boundaries of the finger slot. The fifth portion 68 merges at an edge 70 to form with the sloped region 54.

To provide further support or to increase the height of the wall 75, a portion of the sloped region 54 extending to the edge 37 may include an upwardly rounded edge 72 on either side of a finger slot 50.

In addition, the cylindrical skirt 20 may further include knurls 80 on the outside thereof to help facilitate increase gripping.

It is well within the scope of one or more of the embodiments discussed herein to provide slots 50 with different shapes. For example, as discussed above in one of the embodiments, the slots 50 have a slightly elliptical shape defined by a walled section 75 extending outwardly around from the fifth portion 68. The slots 50, however, could have a slightly rectangular shape, if the fifth portion 68 was substantially flat and facing the opening of the slot 50 with the walled section 75 extending from each end of the fifth portion towards the opening of the slot 50. In addition, other shapes may be defined by the angle, length or position of the walls or portions of the slots.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. A closure for a container, the closure comprising:

a cylindrical skirt depending downwardly from a top portion;

the top portion having a centered region;

a plurality of slots interspaced about the top portion, each slot sized to receive a finger tip of a human hand, each slot being defined as having an opening positioned towards the cylindrical skirt, a back portion radially facing the centered region on the top portion and facing the opening, and a walled section extending from the back portion towards the opening define a partially elliptical form; and an upwardly rounded edge on the secondary edge positioned only between two slots of the plurality of slots, and wherein the top portion further includes a first tapered annular section that extends upwardly and inwardly from the cylindrical skirt and includes a second tapered annular section extending upwardly and inwardly from an intervening edge between the first tapered annular section and the second tapered annular section, the second tapered annular section further having a secondary edge distal from the intervening edge, the secondary edge separating the second tapered annular section from a region sloped upwardly and radially inwardly towards the centered region defined by the top section, and wherein each slot, of the plurality of slots, is further defined as including an indent having a surface boundary formed from the secondary edge of the second tapered annular section which forms into a downwardly sloped section, the surface boundary continues from the downwardly sloped section into a bowed section and then merges into an upwardly sloped section, the upwardly sloped section then levels into an extension section moving inwardly towards the centered region, the extension section forms into a wall section that merges at an edge with the top section.

2. The closure of claim 1, wherein the first tapered annular section has a higher rise angle then the second tapered annular section.

3. The closure of claim 1, wherein the plurality of slots is defined by having seven slots radially and equally spaced around the top section.

4. A closure for a container, the closure comprising:

a cylindrical skirt depending downwardly from a top portion;

the top portion having a centered region; and a plurality of slots spaced around the top section, each slot being sized to receive a finger tip of a human hand, each slot having an opening facing the cylindrical skirt, a back side radially facing the centered region and a walled section extending from both ends of the back side, such that the slot has a partially elliptical form, and wherein each slot, of the plurality of slots, is further defined as including an indent having a surface boundary formed from the secondary edge of the second tapered annular section which forms into a downwardly sloped section, the surface boundary continues from the downwardly sloped section into a bowed section and then merges into an upwardly sloped section, the upwardly sloped section then levels into an extension section moving inwardly towards the centered region, the extension section forms into a wall section that merges at an edge with the top section, and wherein the top portion further includes a first tapered annular section that extends upwardly and inwardly from the cylindrical skirt and includes a second tapered annular section extending upwardly and inwardly from an intervening edge between the first tapered annular section and the second tapered annular section, the second tapered annular section further having a secondary edge distal from the intervening edge, the secondary edge separating the second tapered annular section from a region sloped upwardly and radially inwardly towards the centered region defined by the top section.

5. The closure of claim 4, wherein the first tapered annular section has a higher rise angle then the second tapered annular section.

6. The closure of claim 4 further comprising an upwardly rounded edge on the secondary edge positioned only between two slots of the plurality of slots.

7. The closure of claim 4, wherein the plurality of slots is defined by having seven slots radially and equally spaced around the top section.

8. The closure of claim 4, wherein each slot of the plurality of slots has a partially elliptical form.

9. A closure for a container, the closure comprising:

a top portion having a centered region; and a plurality of indents radially and equally spaced around the top portion, each indent being sized to receive a finger tip of a human hand, each indent having a bottom defined from an opening of the indent to a back wall and defined between walled sections extending from the back wall to the opening, both the opening and the back wall radially face the centered region, and wherein the bottom is further defined from the opening as having a downwardly sloped section, a bowed section from the downwardly sloped section that merges into an upwardly sloped section, the upwardly sloped section then levels into an extension section moving inwardly towards the centered region, the extension section forms into the back wall, and wherein the top portion further includes an annular region positioned between the plurality of indents and an outer edge defined by the top portion, the annular region further includes a first tapered annular section that extends upwardly and inwardly from the outer edge and includes a second tapered annular section extending upwardly and inwardly from an intervening edge between the first tapered annular section and the second tapered annular section.

10. The closure of claim 9, wherein the first tapered annular section has a higher rise angle than the second tapered annular section.

11. The closure of claim 9 further comprising an upwardly rounded edge on the secondary edge positioned only between two indents, of the plurality of indents.

12. The closure of claim 9, wherein the plurality of indents is defined by having seven indents.

* * * * *